United States Patent [19]

Kennedy et al.

[11] Patent Number: 4,698,044

[45] Date of Patent: Oct. 6, 1987

[54] ARTICULATED TOY VEHICLE

[76] Inventors: Melvin R. Kennedy, 2 Fifth Ave., New York, N.Y. 10011; Dietmar Nagel, 147 South Rd., Chester, N.J. 07930; Abraham A. Arad, 6 Minuteman Hill, Westport, Conn. 06880

[21] Appl. No.: 852,288

[22] Filed: Apr. 15, 1986

[51] Int. Cl.[4] ..... A63H 17/05

[52] U.S. Cl. ..... 446/434; 446/462; 446/465

[58] Field of Search ..... 446/434, 462, 463, 457, 446/467, 431, 433, 464, 470, 376

[56] References Cited

U.S. PATENT DOCUMENTS

| | | | |
|---|---|---|---|
| 2,595,936 | 5/1952 | Goode, Jr. | 446/470 X |
| 3,540,151 | 11/1970 | Ishida | 446/462 X |
| 3,886,601 | 6/1975 | Findlay | 446/376 X |
| 4,459,776 | 7/1984 | Jaworski et al. | 446/462 |
| 4,529,389 | 7/1985 | Kennedy et al. | 446/429 X |

FOREIGN PATENT DOCUMENTS

| | | | |
|---|---|---|---|
| 808439 | 7/1949 | Fed. Rep. of Germany | 446/457 |

*Primary Examiner*—Mickey Yu

*Attorney, Agent, or Firm*—Michael Ebert

[57] ABSTRACT

An articulated toy vehicle capable of negotiating a difficult terrain such as a terrain characterized by successive troughs and peaks and other irregularities. The articulated vehicle is composed of a wheeled tractor section and a series of wheeled trailer sections linked thereto by means of a motor-driven, multi-section drive shaft, each section of which is operatively coupled to a wheel axle of a respective vehicle section. The drive shaft sections are intercoupled by detachable universal joints whereby as the vehicle traverses the difficult terrain, it assumes a sinuous formation conforming to the varying contours of the terrain to provide a distributed traction making it possible for the vehicle to overcome the difficulties presented by the terrain.

5 Claims, 5 Drawing Figures

ARTICULATED TOY VEHICLE

BACKGROUND OF INVENTION

This invention relates generally to motorized toy vehicles, and more particularly to an articulated vehicle composed of a wheeled tractor section and a series of wheeled trailer sections hitched thereto by means of a motor-driven, interlinked, multi-section drive shaft, each shaft section of which is operatively coupled to a wheel axle of a respective vehicle section.

Motion pictures such as "Star Wars" and "The Return of The Jedi," which dramatize combat carried out by Martians and other space creatures on remote planets have captured the imagination of many children. These children therefore seek, in play, to enact their own versions of war games on imaginary planets.

Though the planet is fanciful, it is still necessary to create for purposes of play a seemingly realistic terrain therefor. And for this purpose, the usual inspiration is the now familiar terrain of the moon whose appearance has been viewed by millions on television. The reason the moon's terrain is often used as a prototype for the terrain of a remote planet is that it is altogether free of vegetation found on earch and of man-made artifacts such as paved roads and housing structures. The moon's terrain is highly irregular, being formed of troughs, pits, rocky peaks and other non-planar formations.

Hence, if one wishes to provide a toy combat vehicle adapted for play on a miniature replica of a rough planetary terrain, this vehicle must be capable of negotiating the terrain irregularities. The typical toy motorized vehicle, even one having high traction wheels, though capable of traveling over flat roads or of riding up and down gently sloped or contoured surfaces, cannot, without stalling, traverse a terrain composed of successive troughs and peaks, or a succession of miniature hills and dales.

Thus, while a conventional motorized toy vehicle can travel without difficulty down a small peak into a trough, if the vehicle then encounters another peak and has to climb out of the trough up this peak, it lacks the drive power to do so. The typical motorized vehicle has no automatic transmission and cannot shift to a low gear to augment its drive power. Hence, while for play purposes one can provide a child with a miniature replica of a highly irregular planetary terrain on which to conduct war games or other exercises, toy vehicles capable of traversing this terrain are not commercially available.

SUMMARY OF INVENTION

In view of the foregoing, the main object of this invention is to provide an articulated toy vehicle composed of a wheeled tractor section and a series of wheeled trailer sections hitched thereto, each of the sections being driven whereby the articulated vehicle is capable of negotiating a highly irregular terrain.

More particularly, an object of this invention is to provide an articulated toy vehicle of the above-noted type in which the vehicle is provided with a multi-section motor-driven drive shaft, each section of which is operatively coupled to a respective section of the vehicle, so that each of the several vehicle sections is driven, thereby distributing the traction along the length of the articulated vehicle.

A significant feature of the invention resides in detachable universal joints which link the sections of the multi-section drive shaft, making it possible for the sections of the vehicle to assume a snake-like or sinuous formation conforming to the contours of the terrain and affording a distributed traction. This distributed traction enables the vehicle to overcome the difficulties presented by the terrain. And because the joints are detachable, the player can add or subtract, as he wishes, from the number of trailer sections linked to the tractor section. Thus, the multi-section drive shaft not only drives the various sections of the vehicle, but it also serves to interlink these sections.

Briefly stated, these objects are attained in an articulated toy vehicle capable of negotiating a difficult terrain such as a terrain characterized by successive troughs and peaks and other irregularities. The articulated vehicle is composed of a wheeled tractor section and a series of wheeled trailer sections linked thereto by means of a motor-driven, multi-section drive shaft, each section of which is operatively coupled to a wheel axle of a respective vehicle section. The drive shaft sections are intercoupled by detachable universal joints whereby as the vehicle traverses the difficult terrain, it assumes a sinuous formation conforming to the varying contours of the terrain to provide a distributed traction making it possible for the vehicle to overcome the difficulties presented by the terrain.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figures 1, 5:
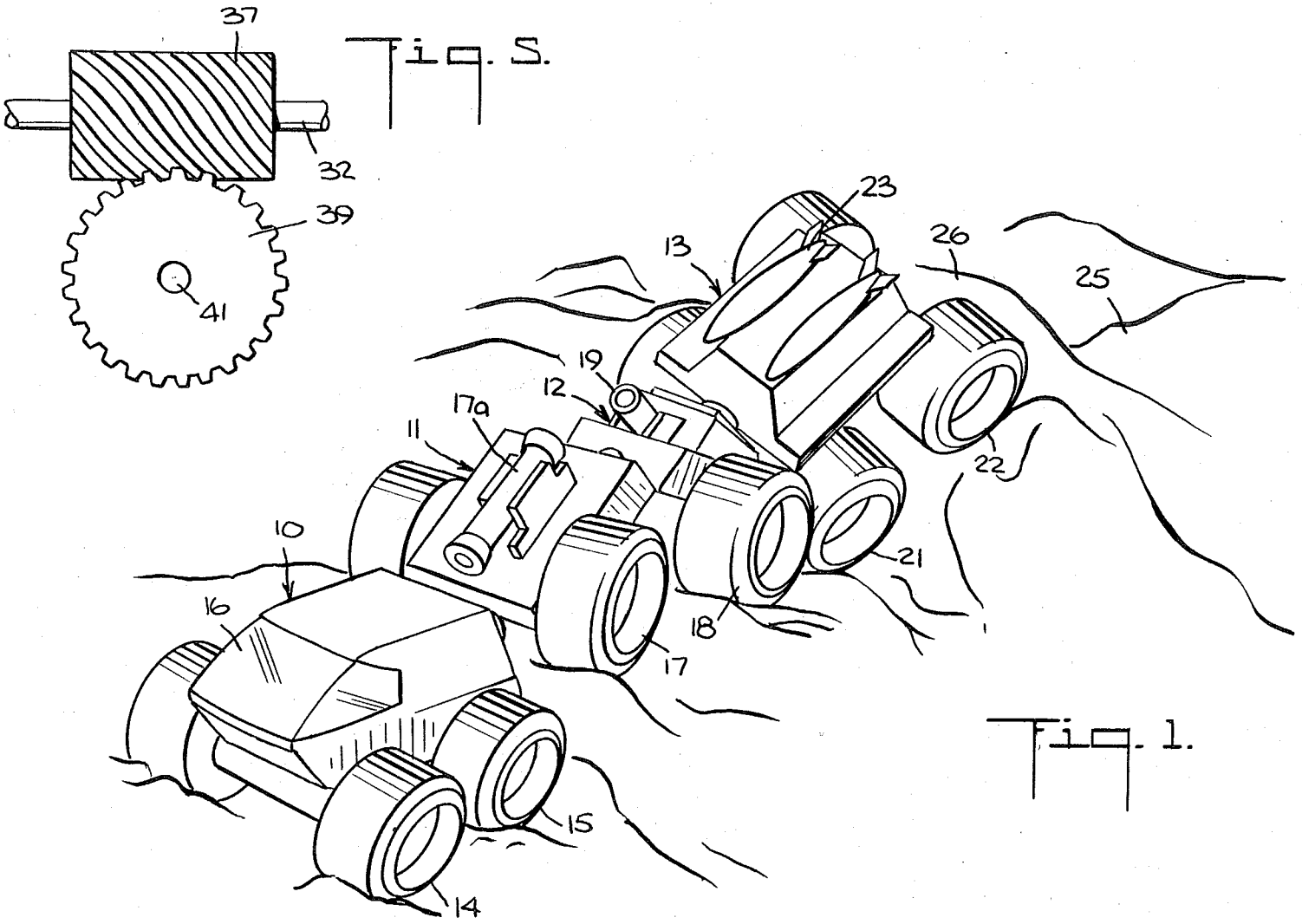
FIG. 1 is a perspective view of an articulated toy vehicle in accordance with the invention as seen traveling over a difficult terrain, the vehicle having a tractor section and a series of three trailer sections hitched to the tractor section.
FIG. 5 illustrates the gears which intercouple a drive shaft section to the axle of the wheels driven thereby.
Figure 2:
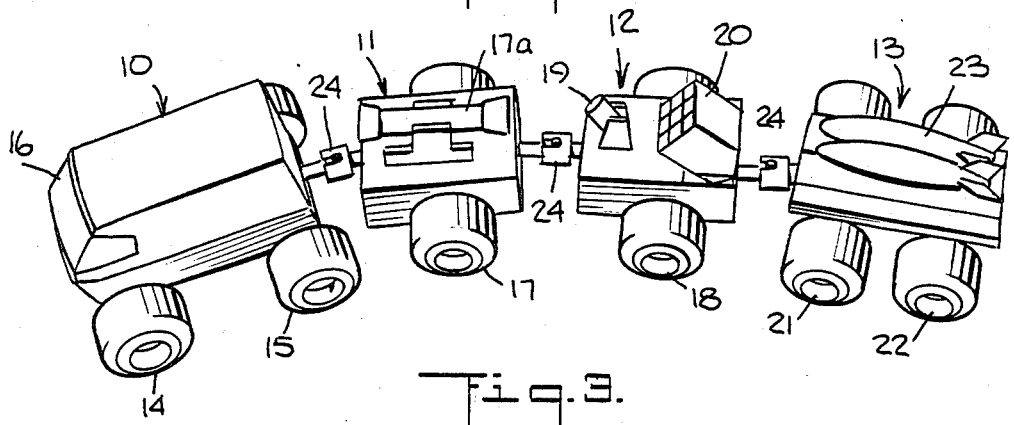
FIG. 2 is a perspective view of the same vehicle as seen on a flat terrain.

Referring now to FIGS. 1 and 2, there is shown one preferred embodiment of an articulated toy vehicle in accordance with the invention, the vehicle being composed of a tractor section 10 and a series of three trailer sections 11, 12 and 13 hitched to the tractor section.

The articulated vehicle is of a military combat type, the tractor section 10 including a set of front and rear wheels 14 and 15 and a body having a transparent cockpit 16 for the military driver. The first trailer section 11 has a single set of wheels 17 and a flat bed supporting a cannon 17A. The second trailer section 12 also has a single set of wheels 18 and a flat bed on which are supported a mortar 19 and a multicell rocket launcher 20. The third trailer section 13 has front and rear wheel sets 21 and 22 and a bed to support a pair of bombs 23.

The nature of the various vehicle sections as shown in FIGS. 1 and 2, is by way of example only, for many other forms are possible. Thus, the tractor section may be provided with a gun turret or other structures, and the trailer sections may be in other simulated weapon forms. In all cases, as best seen in FIG. 2, the sections of the articulated vehicle are interlinked by means of detachable universal joints 24, to be later described in greater detail.

The articulated vehicle is capable of negotiating a very difficult terrain which in the example illustrated in FIG. 1 is composed of a miniature dale 25 which leads into a rough peak 26 having a series of irregular depressions therein. This in turn is followed by another dale or trough (not shown), which leads into another rough peak or small hill (not shown). As the articulated vehicle travels over this rough terrain, the sections thereof, because of the universal joints which intercouple the sections, orient themselves to conform to the varying contours of the terrain so that the articulated vehicle assumes a snake-like or sinuous formation.

As will be later explained, a set of wheels in each section of the articulated vehicle is powered by a related section of a multi-section motor-driven drive shaft; hence the traction is distributed, making it possible for the vehicle to overcome the difficulties presented by the terrain.

Figure 3:
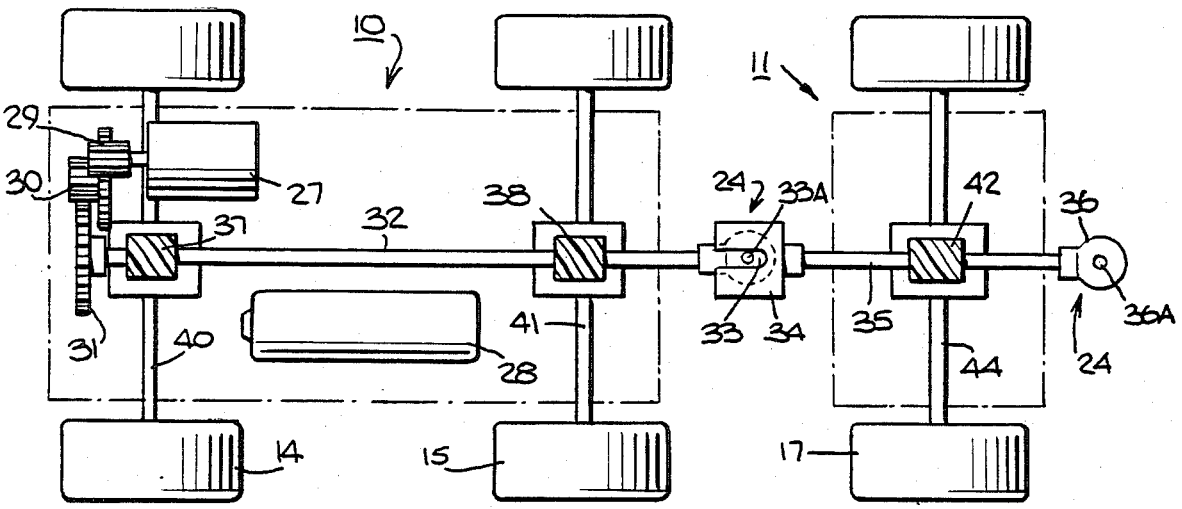
FIG. 3 is a top view of the driven wheels of the tractor section of the vehicle and of the first trailer section linked thereto, the other trailer sections being omitted.
Figure 4:
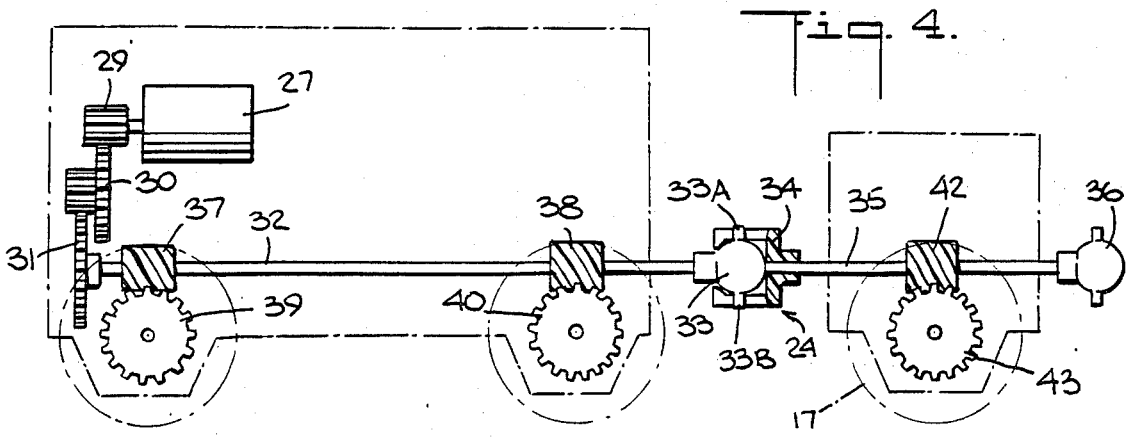
FIG. 4 is a side view of the drive arrangement shown in FIG. 3.

FIGS. 3 and 4 show only the driven wheels 14 and 15 of the tractor section 10 and the driven wheels 17 of the first trailer section linked to the tractor section by universal joints 24. Since the second and third trailer sections are interlinked by like universal joints to the first trailer section and their wheels are driven in the same manner as the wheels of the first trailer sections, the second and third trailer sections have been omitted.

Tractor section 10 is provided within its body with a miniature direct-current motor 27 of relatively high power, the motor being energized by a replaceable battery 28 or a group thereof, depending on the motor voltage requirements. A spur gear 29 mounted on the shaft of motor 27 is coupled through an intermediate gear 30 to a drive gear 31. Drive gear 31 is keyed to the front end of the first section 32 of a multisection drive shaft, which first section is supported for rotation longitudinally within the tractor section at right angles to the axles of the wheels.

The rear end of drive shaft section 32 terminates in the ball 33 of the universal joint 24. This ball, which is provided with diametrically-opposed pivot pins 33A and 33B is received within a slotted socket 34 having a spherical cavity therein adapted to capture the ball. Socket 34 is formed of resilient plastic or rubber-like material whereby the ball may be snapped therein or detached therefrom by the player. Thus, the player can add as many trailers to the tractor section as he wishes.

Socket 34 of the universal joint is attached to the front end of a second section 35 of the multi-section drive shaft, this section being supported for rotation within the first trailer 11. Drive shaft section 35 terminates in the ball 36 of the next universal joint 24 which links first trailer 11 to a drive shaft section (not shown) in the second trailer, and this drive shaft section is similarly linked by a universal joint to the drive shaft section of the third trailer section.

Mounted at spaced positions on the first section 32 of the multi-section drive shaft driven by motor 27 through drive gear 31 are two helical gears 37 and 38. These gears engage helical gears 39 and 40, respectively mounted on the parallel axles 41 and 42 for the front and rear wheels 14 and 15 of the tractor. FIG. 5 shows the intermeshing relationship of helical gear 37 on the first drive shaft section 32 to the helical gear 39 mounted on wheel axle 41.

Drive shaft section 35 for the first trailer section 11 is provided with a helical gear 42 which engages a helical gear 43 on the axle 44 of the wheels 17, so that this trailer section is also driven. The wheel axles of the second and third trailer sections are driven by respective drive shaft sections in the same manner.

Thus, all sections of the articulated vehicle are driven by the corresponding sections of the drive shaft, thereby distributing the traction throughout the length of the vehicle and making it possible to negotiate the most difficult terrain. And because of the universal joints intercoupling the sections, the vehicle assumes a snake-like formation conforming to the contours of the terrain.

While there has been shown and described a preferred embodiment of an articulated toy vehicle in accordance with the invention, it will be appreciated that many changes and modifications may be made therein without, however, departing from the essential spirit thereof.

We claim:

1. An articulated toy vehicle of adjustable length capable of negotiating a terrain having varying contours comprising:

A. a tractor section provided with front and rear wheel axles, and at least first and second trailer sections, each having a wheel axle;

B. a battery-operated motor mounted on said tractor section;

C. A multi-section drive shaft whose first shaft section is mounted for rotation on said tractor section at right angles to the front and rear wheel axles, whose second shaft section is mounted for rotation on said first trailer section at right angles to the wheel axle thereof, and whose third shaft section is mounted for rotation on said second trailer section at right angles to the wheel axle thereof;

D. a snap-fit universal joint detachably coupling the rear end of the first drive shaft section to the front end of the second drive shaft section, thereby linking the tractor section to the first trailer section, and a snap-fit universal joint detachably coupling the rear end of the second drive shaft section to the front end of the third drive shaft section, thereby linking the first trailer section to the second trailer section whereby the tractor section and the first and second trailer sections are capable of assuming a sinuous formation to conform to the varying contours of the terrain;

E. means operatively coupling the motor to the front end of the first section of the drive shaft to cause said first shaft section and the second and third shaft sections coupled thereto to rotate; and F. means operatively coupling said first shaft section to at least one of said front and rear wheel axles in said tractor section and said second shaft section to the wheel axle in said first trailer section and said third shaft section to the wheel axle in said second trailer section, whereby the vehicle traction is distributed between said tractor section and said first and second trailer sections.

2. A vehicle as set forth in claim 1, wherein said motor is operatively coupled to said first shaft section by means of a spur gear mounted on the shaft of the motor, a drive gear mounted on the front end of said first shaft section, and an intermediate gear intercoupling the spur gear and the drive gear.

3. A vehicle as set forth in claim 1, wherein said first shaft section is operatively coupled to both the front and rear wheel axles of the tractor section.

4. A vehicle as set forth in claim 1, wherein said drive shaft sections are coupled to the respective wheel axles by means of a helical gear mounted on said drive shaft sections in intermeshing relatioship to a helical gear mounted on said wheel axles.

5. A vehicle as set forth in claim 1, wherein said universal joint is constituted by a ball having a pair of opposing pivot pins, and a socket having a recess and slots for receiving said ball and pins, respectively, said socket being formed of resilient material whereby the ball may readily be attached and detached by a player from the socket.

* * * * *